United States Patent [19]

Rastogi et al.

[11] Patent Number: 4,464,111

[45] Date of Patent: Aug. 7, 1984

[54] SYSTEM AND PROCESS FOR CONTROLLING A CALCINER

[75] Inventors: Laxmi K. Rastogi, San Jose, Calif.; Scot W. Sussman, Aurora, Colo.

[73] Assignee: Measurex Corporation, Cupertino, Calif.

[21] Appl. No.: 435,387

[22] Filed: Oct. 20, 1982

[51] Int. Cl.[3] ..... F27B 7/20

[52] U.S. Cl. ..... 432/24; 432/78; 432/106; 110/212

[58] Field of Search ..... 432/78, 24, 105, 106, 432/72; 110/191, 212

[56] References Cited

U.S. PATENT DOCUMENTS

| | | | |
|---|---|---|---|
| 3,091,443 | 5/1963 | Herz et al. | 432/78 |
| 3,276,755 | 10/1966 | Bast | 432/78 |
| 3,437,325 | 4/1969 | Putnam et al. | 432/24 |
| 3,610,596 | 10/1971 | Snyder | 432/24 |
| 3,807,321 | 4/1974 | Stockman | 110/212 |
| 4,038,032 | 7/1977 | Brewer et al. | 110/212 |
| 4,059,396 | 11/1977 | Dano | 432/106 |
| 4,245,571 | 1/1981 | Przewalski | 110/212 |
| 4,260,369 | 4/1981 | Wonshawsky | 432/106 |

*Primary Examiner*—Henry C. Yuen

*Attorney, Agent, or Firm*—Hal J. Bohner

[57] ABSTRACT

A process for controlling a calciner system is disclosed wherein the temperatures of the calcined product and the flue gas, and the rate of fuel flow to the burner are measured. A fuel flow set point is determined from the product and flue gas temperatures and the rate of fuel flow to the burner is controlled to the set point.

9 Claims, 3 Drawing Figures

SYSTEM AND PROCESS FOR CONTROLLING A CALCINER

BACKGROUND OF THE INVENTION

1. The field of The Invention

This invention concerns a system and process for controlling the operation of the calciner system.

2. State of The Art

A calciner is a device for heating material in order to bring about physical or chemical reactions in the material to produce a product. One conventional type of calciner is a rotary, co-current calciner. Such a calciner includes a rotatable cylinder for containing the material during the heating and reaction process. The rotatable cylinder is slightly inclined and coupled to the upper end of the cylinder is a stationery heating plenum which contains a burner to burn fuel to thereby provide heat for the calcining process. A forced draft fan is coupled to the heating plenum to provide air for combustion in the burner and also to carry heated gases through the rotating cylinder. At the opposite, lower end of the rotatable cylinder, a stationary receiving duct is coupled. The receiving duct has a screw conveyer disposed at its lower end so that calcined material leaving the rotating cylinder falls into the screw conveyer to be conveyed to storage. An induced draft fan is coupled to the upper end of the receiving duct to pull flue gases from the rotating cylinder and the receiving duct.

One conventional use for a co-current calciner such as described above is to calcine sodium sesquicarbonate ($Na_2CO_3.NaHCO_3.2H_2O$) to soda ash ($Na_2CO_3$). When sodium sesquicarbonate is converted to soda ash in a conventional calcining process, the following reactions occur.

$$Na_2CO_3.NaHCO_3.2H_2O + Heat \rightarrow Na_2CO_3 + NaHCO_3 + 2H_2O \text{ (vapor)}$$

$$2Na_2CO_3 + 2NaHCO_3 + 4H_2O \text{ (vapor)} + Heat \rightarrow 3Na_2CO_3 + 5H_2O + CO_2 + Heat$$

$$3Na_2CO_3 + 5H_2O + CO_2 + Heat \rightarrow (3-x)Na_2CO_3 + xNa_2O + 5H_2O + (1+x)CO_2$$

In the conversion of sodium sesquicarbonate to soda ash, the extent to which the sodium sesquicarbonate is heated is important. If insufficient heat is applied, all of the sodium bicarbonate ($NaCO_3$) is not converted to soda ash. On the other hand, if too much heat is applied, soda ash is converted to sodium oxide ($Na_2O$) which is not a desirable end product. Thus in conventional processes for calcining sodium sesquicarbonate, the product resulting from the calcining operation is periodically taken to a laboratory and analyzed to determine the amount of sodium bicarbonate and sodium oxide in the products. In the laboratory analysis the sample is dissolved in water and analyzed on a wet basis. The following reactions occur:

$$Na_2O + H_2O \rightarrow 2NaOH$$

$$NaOH + NaHCO_3 \rightarrow Na_2CO_3 + H_2O$$

Thus $Na_2O$ and $NaHCO_3$ react with one another to produce $Na_2CO_3$ and any excess $Na_2O$ is reported as NaOH, while $NaHCO_3$ is measured directly. Likewise, in the calcining process itself the soda ash is often used in a water solution so that the same reactions occur. During laboratory analysis, if either sodium hydroxide or sodium bicarbonate is found in excessive quantities, then the calcining process is altered. Often, control of the process is accomplished by controlling the fuel supplied to the burner and controlling the amount of air supplied by the forced draft fan.

It can be seen that the laboratory measurement of the sodium bicarbonate and sodium oxide in the product is not a completely satisfactory basis for controlling the process. This is because the measurement takes substantial time and therefore large quantities of product can be produced which contain too much sodium bicarbonate or sodium oxide. Furthermore, the application of excessive heat to the material in the calciner is undesirable because valuable fuel is wasted, but if laboratory analysis is used to determine the sodium oxide in the product, large amounts of heat can be wasted before the process is controlled.

OBJECTS OF THE INVENTION

It is an object of the present invention to provide a system and process for controlling a calciner rapidly and accurately.

Further objects and advantages of the present invention can be asertained by reference to the text and drawings herein, which are offered by way of example and not in limitation of the invention which is defined by the claims and equivalents thereto.

BRIEF DESCRIPTIONS OF THE DRAWINGS

DETAILED DESCRIPTION OF THE PREFERRED EMBODIMENT

Figure 1:
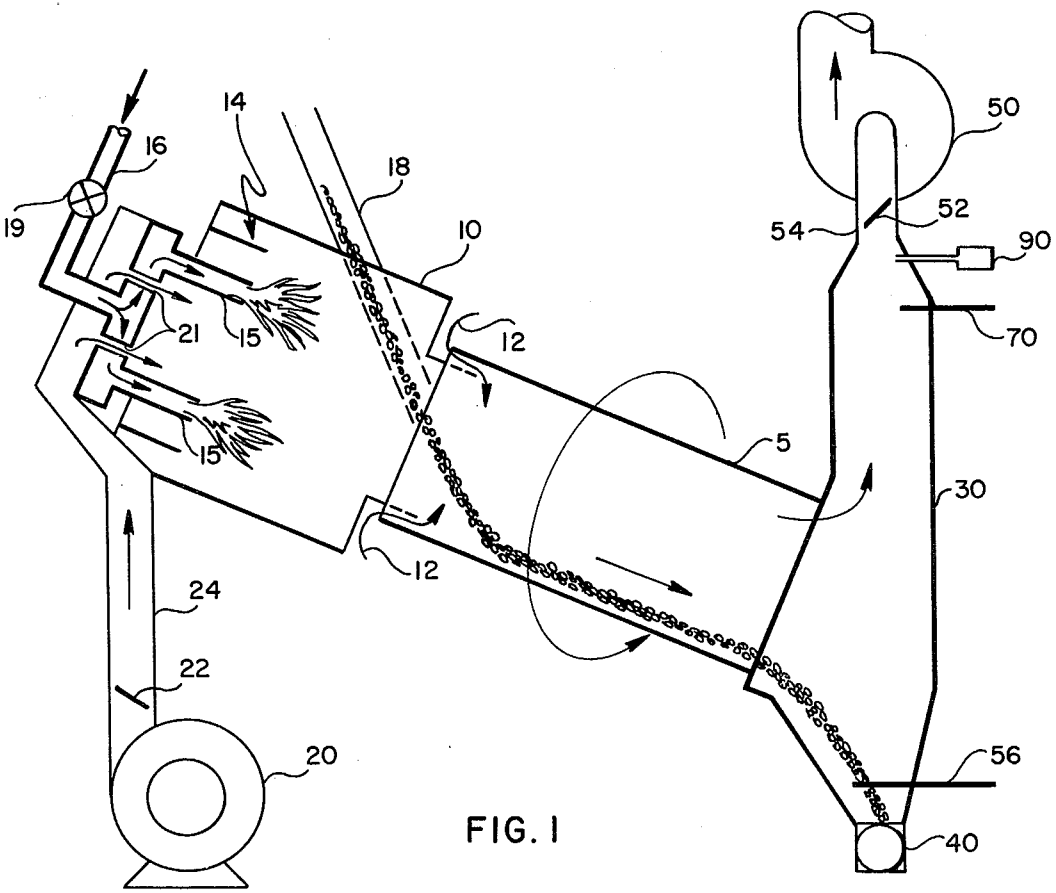
FIG. 1 is a schematic illustration of a calciner according to the present embodiment.

The calciner system shown in FIG. 1 includes a rotatable calciner cylinder 5 which is mounted on drive means, not shown. The rotatable cylinder 5 is conventional and contains a plurality of baffles located generally in an axial direction on its interior so that when it rotates, material inside is carried upward to thereafter fall to the floor of the cylinder. The cylinder 5 is higher at its left end than at its right end so that as it rotates the baffels insure that material in the cylinder tumbles through thereby contacting hot gases flowing through the cylinder. An integral windbox and burner 10 is coupled at the upper, left end of the cylinder 5. The windbox 10 is slightly spaced apart from the cylinder 5 so that leakage air, shown by arrow 12, can enter into the upper end of the rotatable cylinder. A burner 14 is coupled to the left end of the heating plenum 10 and a fuel feed line 16 is coupled to provide fuel to the burner pipe 15. A feed means 18 is coupled to the left end of the calciner for introducing material into the calciner. The burner provides hot gases to calcine the material traveling through the rotatable cylinder 5. A forced draft fan 20 is connected to the windbox 10 via conduit 24 to provide air through parts 21 for combustion in the burner and to convey hot gases through the cylinder 5. A damper 22 is connected in conduit 24 to permit control of the amount of air flowing through the conduit.

At the right, lower end of the rotatable cylinder 5 a stationary receiving duct 30 is disposed. A screw conveyer 40 is located at the bottom of the receiving duct 30 to convey calcined product material leaving the cylinder 5. An induced draft fan 50 is coupled at the upper end of the receiving duct 30 via conduit 54 to pull gases through the cylinder 5 and the receiving duct 30. A damper 52 is connected in the conduit 54 to permit control of the amount of flue gas passing through the conduit 54.

Temperature probes 56 and 70 are located in the receiving duct 30 to measure the temperatures of the product material and the flue gas, respectively. The temperature sensitive section of probe 56 is located in the product material. A flue gas analyzer 90 is located to receive gases from the induced draft fan 50 and is capable of measuring carbon monoxide.

Figure 2:
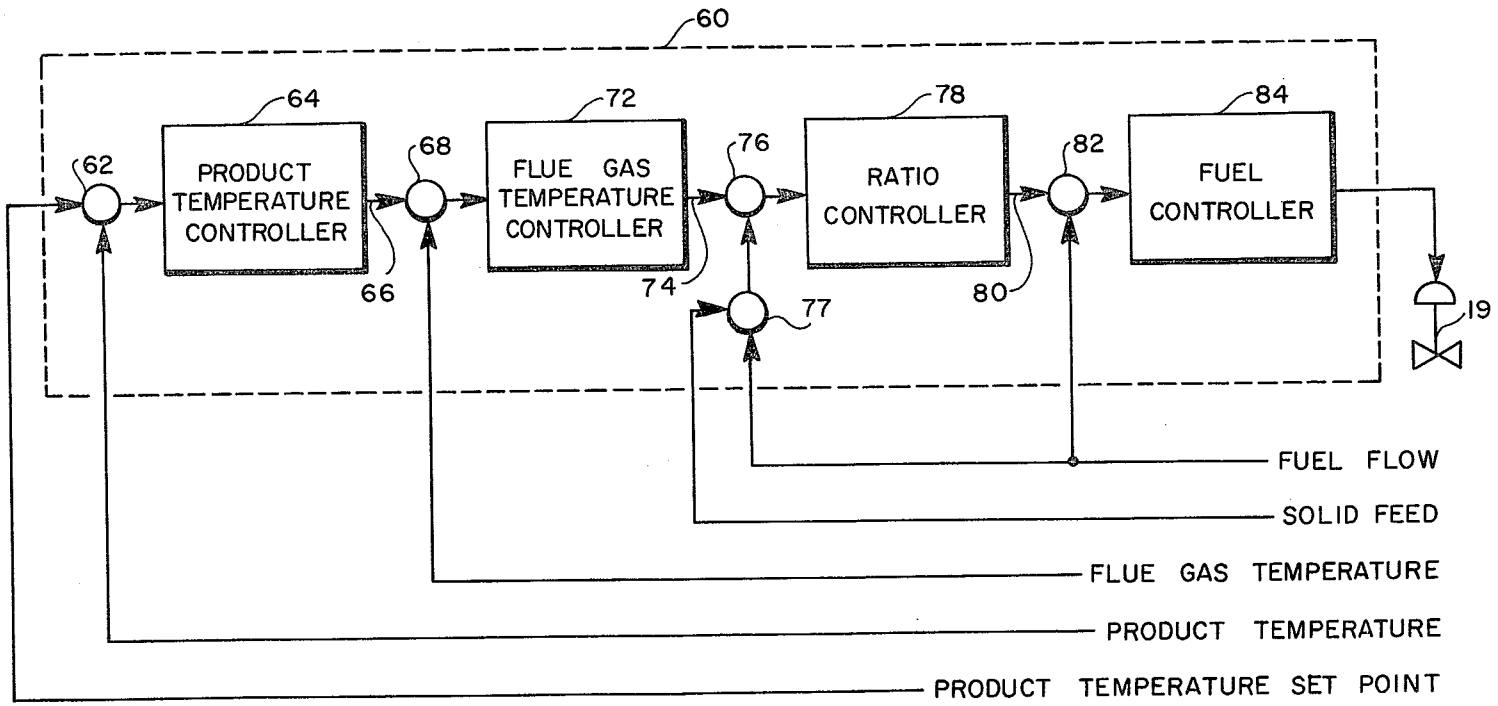
FIG. 2 is a schematic illustration of one part of the present embodiment.

FIG. 2 shows one part of the control system to control the calciner according to the preferred embodiment. It should be understood that FIG. 2 is a schematic illustration of various steps performed by the control system some of which are performed by a digital computer. The operations performed by the digital computer are illustrated in the box labeled 60.

During the operation of the calciner, calcined product travels from the lower end of the rotatable cylinder 5 through the receiving duct 30 and into the screw conveyer 40. Periodically, a sample of the product is removed from the screw conveyer and analyzed to determine the concentration, if any, of sodium bicarbonate or sodium hydroxide in a water solution of the product. If the sodium bicarbonate exceeds a perdetermined value, then the product temperature set point is increased in proportion to the percent sodium bicarbonate value. On the other hand, if the sodium hydroxide concentration exceeds a predetermined value then the product temperature set point is decreased in proportion to the sodium hydroxide concentration. Information concerning the product temperature set point is entered into the digital computer 60.

The digital computer 60 continuously receives a signal representing the value of the temperature of the product measured by the temperature probe 56. The product temperature signed is illustrated schematically as being received by node 62. The computer then compares the measured product temperature with the product temperature set point as illustrated by the product temperature controller 64. The product temperature controller 64 compares the measured temperature of the product with the product set point value to determined a flue gas set point 66 which is entered into node 68. Node 68 also receives the measured flue gas temperature determined by temperature probe 70. The flue gas temperature controller 72 compares the measured temperature of the flue gas with the flue gas set point to determine a fuel to solid feed ratio set point 74 and the set point is entered into node 76. The measured fuel flow and measured solid feed rate are entered into node 77 which determines the ratio of fuel solid feed. The ratio value is entered into ratio controller 78 which determines a fuel set point 80. The fuel set point 80 is compared with the actual measured fuel flow as measured by a flow meter, not shown, which is coupled to the fuel feed lines 16. The fuel controller 84 compares the measured fuel flow with the fuel set point 80 and controls the fuel valve 19 based on the comparison.

It should be noted that the ratio controller 78 can be eliminated from this control scheme and if this is done, the flue gas temperature controller 72 generates the fuel set point 80.

In operation, the product temperature set point is determined periodically based on laboratory analysis of product samples. The set point information is manually entered into the digital computer 60 and thereafter the system can operate until new data concerning the analysis of the product is available. Between analyses of the product the system operates as follows. The temperature of the product discharged from the calciner cylinder is continuously measured and the values of the measured temperature are electronically entered into the digital computer 60. The computer compares the measured temperature of the product to the product set point which was manually entered, thereby to determine a flue gas set point. Once every fifteen seconds the computer updates the flue gas set point based upon data collected during the preceding fifteen seconds.

The temperature of the flue gas is continuously measured and the computer compares the measured temperature of the flue gas with the flue gas set point to determine a fuel set point. The rate of flow of fuel into the burner is continuously measured and the computer compares the measured rate of fuel flow with the fuel set point and generates a control signal to control the valve 19. Thus the valve 19 is controlled based upon the comparison of the measured rate of fuel flow with the fuel set point so that the actual fuel flow is maintained at or near the fuel flow set point.

We have conducted tests of a calciner utilizing the system and process discussed above and found it to be effective. For example, our process insures that the temperature of the product does not vary substantially from its target and thus conversion to sodium carbonate is substantially complete while the sodium carbonate is not converted to sodium oxide in substantial quantities. One feature of the present embodiment which insures this advantageous result is the use of flue gas temperature to control fuel flow. In one application of our system we have found that material takes about eight (8) minutes to pass through the cylinder whereas flue gas takes less than about one minute to travel the same distance from the burner to the probe 70. Thus by controlling fuel flow based primarily on flue gas temperature we insure that there is no substantial time delay between variations in temperature at the burner 14 and control of the burner. Furthermore, we have found that our system is considerably more fuel efficient than if the system were operated manually. Specifically, in one application we have found about a ten percent (10%) reduction in fuel usage, resulting from an average reduction in product temperature of about 13%.

Figure 3:
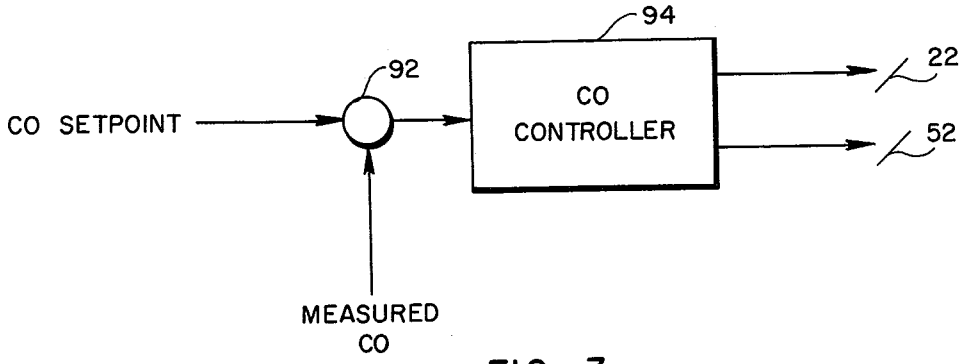
FIG. 3 is a schematic illustration of another part of the present embodiment.

Another aspect of the present embodiment is illustrated in FIG. 3 which schematically illustrates the control system for controlling carbon monoxide (CO).

Carbon monoxide is measured in the receiving duct 30 by analyzer 90. The measured carbon monoxide values are transmitted to a carbon monoxide control system which is includes the digital computer 60. As shown in FIG. 3, the measured value of carbon monoxide is transmitted to a node 92 which also receives the predetermined carbon monoxide set point entered by an operator. The carbon monoxide controller 94 compares the measured concentration of carbon monoxide with the carbon monoxide set point and controls either the forced draft damper 22 or the induced draft damper 52. If the forced draft damper is open less than a predetermined maximum, then the carbon monoxide controller 94 controls only the forced draft damper 22 without varying the position of the induced draft damper 52. However, if the forced draft damper 22 is operating at a predetermined open limit, then the carbon monoxide controller 94 controls carbon monoxide by varying position of the induced draft damper 52.

We have found this control system and process to be quite effective in insuring that sufficient air is provided to maximize the combustion of the fuel from the burner while insuring that the amount of air provided is not excessive. Many calciners have no sealing means between the heating plenum 10 and the cylinder 5. Thus leakage air can enter the cylinder 5 as shown by arrows 12. Thus, even when the damper 22 is operating at its maximum open position, additional oxygen for combustion can be provided by increasing the induced draft which in turn increases the amount of leakage 12. We have found that advantageously, the leakage air 12 can interact with the unburned fuel from the burner 14 at a sufficiently hot temperature so that any previously unburned fuel is combusted. Thus, our system assures high utilization of the fuel.

We claim:

1. A process for controlling a calciner system for calcining a material to produce a product, the system including a burner to supply heat to the material, a rotatable calciner cylinder to contain the material and a duct to convey flue gas from the calciner cylinder, the process comprising:

(a) measuring the temperature of the product discharged from the cylinder;

(b) comparing the measured temperature of the product to a product temperature set point to determine a flue gas set point;

(c) measuring the temperature of the flue gas;

(d) comparing the measured temperature of the flue gas with the flue gas temperature set point to determine a fuel set point;

(e) measuring the rate of flow of fuel to the burner; and (f) comparing the measured rate of fuel flow with the fuel set point and controlling the fuel flow based upon the comparison.

2. A process according to claim 1 wherein the temperature of the discharged product is measured by a probe disposed in the product.

3. A process according to claim 1 wherein the material includes sodium sesquicarbonate.

4. A process according to claim 3 wherein the product includes soda ash.

5. A process according to claim 4 wherein the product temperature set point is determined based upon analysis of sodium bicarbonate and sodium hydroxide in a water solution of the product.

6. A system to control a calciner for calcining material to produce a product comprising:

(a) a rotatable calciner cylinder;

(b) a burner coupled to one end of the calciner cylinder to produce hot gas;

(c) means to introduce the material into the cylinder near the burner so that the material and hot gas flow co-currently through the cylinder;

(d) an exhaust duct to remove flue gas from the cylinder;

(e) means to measure the temperature of the product discharged from the cylinder;

(f) means to compare the measured temperature of the product to a product temperature set point to generate a flue gas set point;

(g) means to measure the temperature of the flue gas;

(h) means to compare the measured temperature of the flue gas with the flue gas temperature set point to determine a fuel set point;

(i) means to measure the rate of flow of fuel to the burner; and (j) means to compare the measured rate of fuel flow with the fuel set point and to control the fuel flow based upon the comparison.

7. A process for controlling a co-current calciner system for calcining a material to produce a product, including a burner to supply heat to the material, a rotatable calciner cylinder to contain the material, the cylinder having a source of leakage air near the burner, a forced draft fan to supply air to the burner and to carry hot gas from the burner through the cylinder, means to feed the material into the cylinder near the burner so that the material and the hot gas from the burner flow co-currently, a duct to convey flue gas from the calciner cylinder, and an induced draft fan coupled to induce the flow of leakage air and flue gas through the cylinder, the process comprising:

(a) measuring the concentration of carbon monoxide in the flue gas;

(b) comparing the measured concentration of carbon monoxide with a carbon monoxide set point;

(c) controlling the forced draft fan in response to the comparison of measured carbon monoxide with the set point if the forced draft fan is operating below a predetermined limit;

(d) controlling the induced draft fan in response to the comparison of measured carbon monoxide with the set point if the forced draft fan is operating at a predetermined limit.

8. A process according to claim 7 wherein the material includes sodium sesquicarbonate and the product includes soda ash.

9. A process according to claim 7 wherein the source of leakage air is located sufficiently close to the burner so that leakage air provides oxygen for combustion of fuel from the burner.

* * * * *